US006902411B2

(12) United States Patent
Kubo

(10) Patent No.: US 6,902,411 B2
(45) Date of Patent: Jun. 7, 2005

(54) CONNECTOR ASSEMBLY

(75) Inventor: Takafumi Kubo, Kanagawa (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 10/901,882

(22) Filed: Jul. 28, 2004

(65) Prior Publication Data

US 2005/0026466 A1 Feb. 3, 2005

(30) Foreign Application Priority Data

Jul. 29, 2003 (JP) ..... 2003-282032

(51) Int. Cl.[7] ..... H01R 12/00
(52) U.S. Cl. ..... 439/74
(58) Field of Search ..... 439/74, 660, 489

(56) References Cited

U.S. PATENT DOCUMENTS 5,697,799 A * 12/1997 Consoli et al. ..... 439/181
6,132,258 A * 10/2000 Kajinuma ..... 439/660
6,135,785 A * 10/2000 Niitsu ..... 439/74

FOREIGN PATENT DOCUMENTS

JP 04-043579 2/1992
JP 05-23429 3/1993

* cited by examiner

*Primary Examiner*—Tho D. Ta
(74) *Attorney, Agent, or Firm*—Barley Snyder

(57) ABSTRACT

There is provided a connector assembly including a pair of connectors each attached to a surface of the circuit board, which provides a positive tactile response when the connectors are correctly connected to each other and assures reliable electrical connection of the connectors to the circuit boards and reliable fixing of the connectors to the circuit boards. A soldering peg of one connector has a pair of engaging arms each of which is spaced apart from a wall of an insulating housing of the connector and capable of being resiliently deformed outwardly. A soldering peg of the other connector has a pair of engaging arms each of which is spaced apart from a wall of an insulating housing of the connector and capable of being resiliently deformed inwardly. The engaging arms of the connectors are unloaded when the connectors are completely connected to each other.

10 Claims, 7 Drawing Sheets

CONNECTOR ASSEMBLY

FIELD OF THE INVENTION

The present invention relates to a connector assembly composed of a pair of surface mount connectors.

BACKGROUND OF THE INVENTION

In recent years, the use of surface-mounted (SMT) connectors for interconnecting circuit boards has grown, because of the ease of electrical connection to elements on the circuit board, the high packaging density of contacts and other advantages. An SMT connector is electrically connected to a circuit board by soldering a soldering part (tine part) of a contact of the connector to a pad on the surface of the circuit board. Some SMT connectors have a soldering peg attached to a housing with an array of contacts. Such SMT connectors with a soldering peg are fixed to a circuit board by soldering the soldering peg to a pad on the surface of the circuit board. However, when the connector is mounted on the circuit board, if the tine parts of the contacts protrude beyond the soldering part of the soldering peg, the connector is inadequately fixed to the circuit board. On the other hand, if the soldering part of the soldering peg protrudes beyond the tine parts of the contacts, the connector cannot be electrically connected to the circuit board, although it can be fixed to the circuit board.

To overcome the problem of alignment of the tine parts of the contacts and the soldering part of the soldering peg when the connector is mounted on the surface of the circuit board, an SMT connector having a soldering peg capable of moving with respect to the surface of the circuit board is suggested in Japanese Utility Model Laid-Open No. 5-23429, for example. A connector assembly having a pair of SMT connectors is described, in which each connector has soldering pegs disposed in a movable manner at the longitudinal ends of the housing thereof.

When paired connectors are connected to each other, it is desirable that the operator can perceive that the connectors are correctly connected to each other. The SMT connector pair described above does not have any mechanism that allows the operator to perceive the correct connection of the connectors. However, there has been proposed another connector pair having a mechanism that allows the operator to perceive that the connectors are correctly connected to each other in Japanese Patent Laid-Open No. 4-43579, for example. Here, a pair of connectors each having plural contacts is described, in which the contacts of one connector have an inward protrusion that protrudes inwardly, and the contacts of the other connector have an outward protrusion that protrudes outwardly and is formed at a resilient part of the contact which can be deflected inwardly. In this connector pair, when connecting the connectors to each other, if one of the connectors is inserted to the other, than the inward protrusions and the outward protrusions come into contact with each other before the connection process is completed. If the insertion is continued, the inward protrusions and the outward protrusions which are in contact with each other interact, and the resilient parts of the contacts on which the outward protrusions are formed are deflected inwardly. Then, the insertion is further continued, and when the connection process is completed, the resilient parts of the contacts with the outward protrusions, which have been deflected inwardly, return to their original positions, and a tactile response is produced. By feeling the tactile response, the operator can know that the connectors are correctly connected to each other.

In recent years, however, downsizing of connectors has been severely required, and to meet the requirement, the connectors have been made thinner. If the mechanism that produces a tactile response described in Japanese Patent Laid-Open No. 4-43579 is used for a low-profile connector assembly, the beam of each contact cannot have a sufficient length. Thus, the contact has a smaller deflection when the connectors are connected to each other, so that an adequate tactile response cannot be produced. In addition, in order to maintain the electrical connection between the contacts with the connectors being connected to each other, the resilient part of the contact having the outward protrusion is designed to return to a state just short of the original state even after the paired connectors are completely connected, so that the resilient part still has some resilient force. The strength of the tactile response produced when the paired connectors described are completely connected depends on to the extent that the resilient part of the contact returns. Thus, if the resilient part has to have some resilient force even after the paired connectors are completely connected, the resilient part cannot return to an adequate extent, so that an adequate tactile response cannot be provided.

SUMMARY OF THE INVENTION

An exemplary connector assembly according to the present invention includes a pair of connectors, each of the connectors having: an insulating housing; contacts arranged in at least one row in the longitudinal direction of the insulating housing; and soldering pegs that are disposed at the longitudinal ends of the insulating housing and capable of moving vertically. The soldering pegs of one of the connectors each have a pair of engaging arms, each of which is spaced apart from a wall of the insulating housing of the connector and capable of being resiliently deformed outwardly. The soldering pegs of the other of the connectors each have a pair of engaging arms, each of which is spaced apart from a wall of the insulating housing of the connector and capable of being resiliently deformed inwardly. The engaging arms of the soldering pegs each have a locking protrusion. The locking protrusions of the engaging arms interacting during connection of the connectors, whereby the engaging arms are loaded due to the interaction between the locking protrusions during connection of the connectors and substantially unloaded when the connectors are completely connected to each other because the interaction between the locking protrusions is eliminated.

DETAILED DESCRIPTION OF THE INVENTION

Following is a description of an exemplary embodiment of the connector assembly of the present invention with reference to the attached drawings.

A connector assembly according to this embodiment is composed of a plug connector and a receptacle connector which mate with each other.

First, the plug connector will be described.

Figure 1:
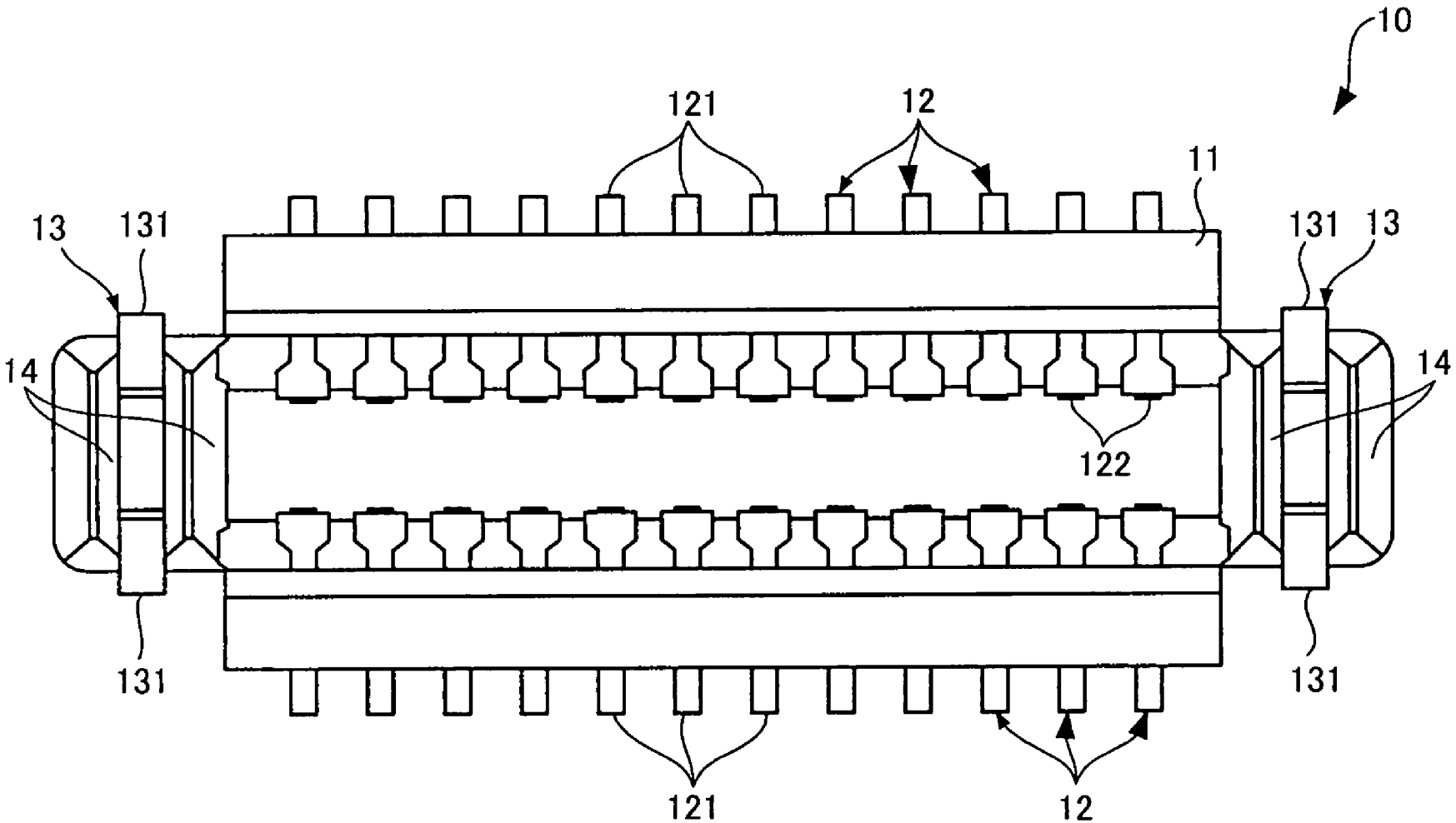
FIG. 1 is a plan view of a plug connector of a connector assembly according to an exemplary embodiment of the present invention.
Figure 2:
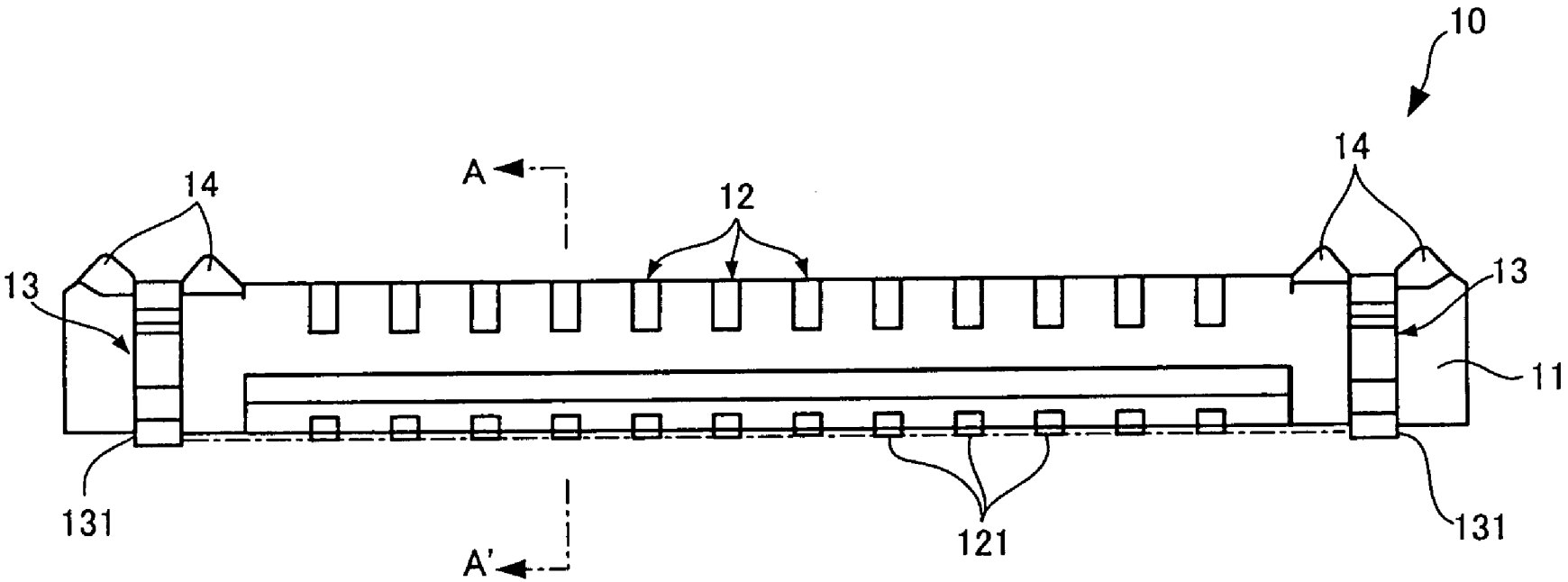
FIG. 2 is a front view of the plug connector shown in FIG. 1.

FIG. 1 is a plan view of the plug connector of the connector assembly according to the embodiment of the present invention. FIG. 2 is a front view of the plug connector shown in FIG. 1, and FIG. 3 is a cross-sectional view of the same connector taken along the line A–A'.

Figure 3:
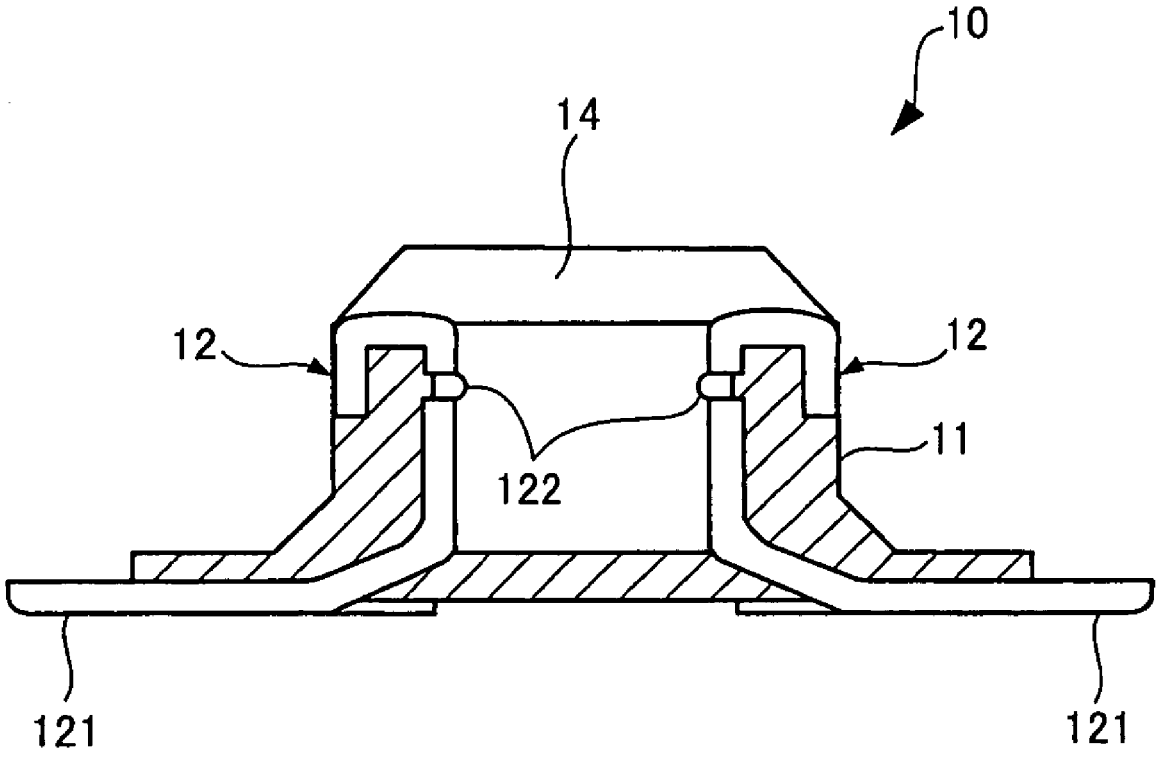
FIG. 3 is a cross-sectional view of the plug connector shown in FIGS. 1 and 2 taken along the line A–A' in FIG. 2.

A plug connector 10, shown in FIGS. 1–3, is a surface-mounted (SMT) connector, which is configured to be mounted on a surface of a circuit board (not shown). In FIGS. 1 to 3 the plug connector 10 is not yet mounted on the circuit board. The plug connector 10 has an insulating housing 11 extending horizontally in this drawing, plural contacts 12 arranged in two rows along the length (the longitudinal direction) of the insulating housing 11, and soldering pegs 13 moveably disposed in respective guiding sections 14 at the longitudinal ends of the insulating housing 11.

The insulating housing 11, shown in FIG. 1, is made of resin.

In FIG. 1, the contacts 12 are shown as arranged in two, upper and lower, rows, and the contacts 12 in the upper row and the contacts 12 in the lower row are arranged to oppose each other. In the illustrated embodiment, each of the contacts 12 is made of a copper alloy and substantially L-shaped (see FIG. 3). One end of each contact 12 constitutes a tine section 121 to be soldered to a pad on the circuit board (not shown). The other end thereof is bent to have an angled U shape, as shown in FIG. 3. In addition, at the latter end, the contact 12 has a projection 122 configured to make contact with a corresponding contact of a mating connector (described hereafter). The projection 122 may be formed by coining, for example, and protrudes toward the opposing contact 12. The tine sections 121 of the contacts 12 have the same height (that is, are aligned at the bottom, as shown by the alternate short and long dash line in FIG. 2) and may be formed in the insulating housing 11 by insert molding, for example.

The soldering pegs 13 shown in FIGS. 1 and 2 are formed to have a high dimensional precision, by only die cutting of one copper alloy plate, for example, without any forming, such as bending. Each soldering peg 13 has a soldering part 131, which is to be soldered to a pad on the circuit board. Since the soldering parts 131 are soldered to the pads on the circuit board, the plug connector 10 is rigidly fixed to the circuit board. That is, the soldering pegs 13 serve to fix the plug connector 10 to the circuit board. The soldering pegs 13 shown in FIGS. 1 and 2 serving in this way are attached to the insulating housing 11 in a movable manner. They can vertically move within a predetermined range. In FIG. 2, the soldering parts 131 of the soldering pegs 13 are shown protruding slightly below the tine sections 121 due to their own weights. However, when mounting the plug connector 10 on the circuit board, the soldering pegs 13 move upward until the level of the soldering parts 131 corresponds with that of the tine sections 121, and the soldering parts 131 comes into contact with the pads on the circuit board. That is, when the plug connector 10 is mounted on the circuit board, the tine sections 121 and the soldering parts 131 are coplanar. Therefore, the plug connector 10 shown in FIG. 1 can be reliably electrically connected to the circuit board by the tine sections 121 and can be reliably fixed thereto by the soldering parts 131. Further description of the soldering pegs 13 will be made later.

Now, the receptacle connector, the other connector in the connector assembly according to this embodiment of the present invention, will be described.

Figure 4:
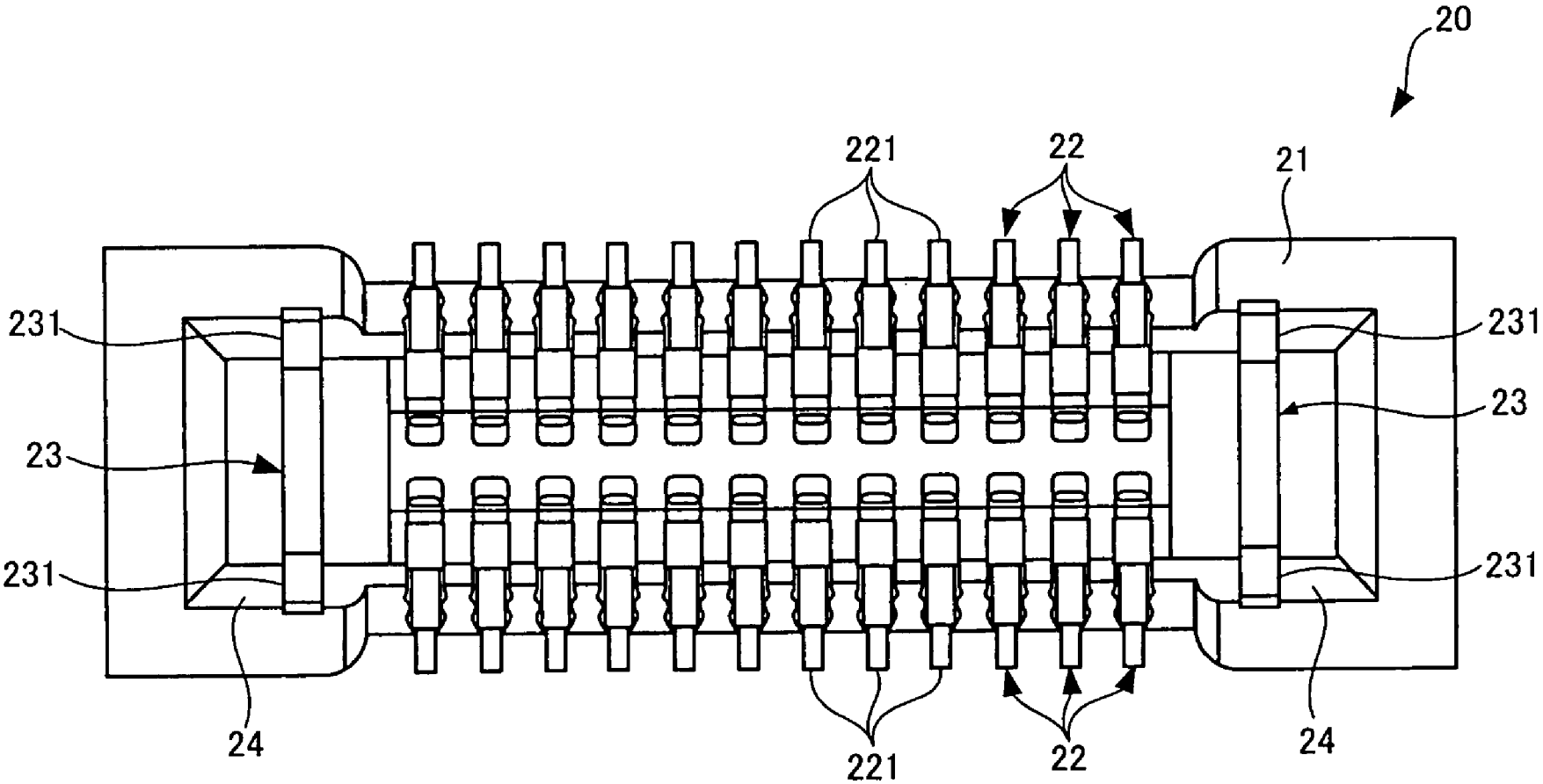
FIG. 4 is a plan view of a receptacle connector of a connector assembly according to an exemplary embodiment of the present invention.
Figure 5:
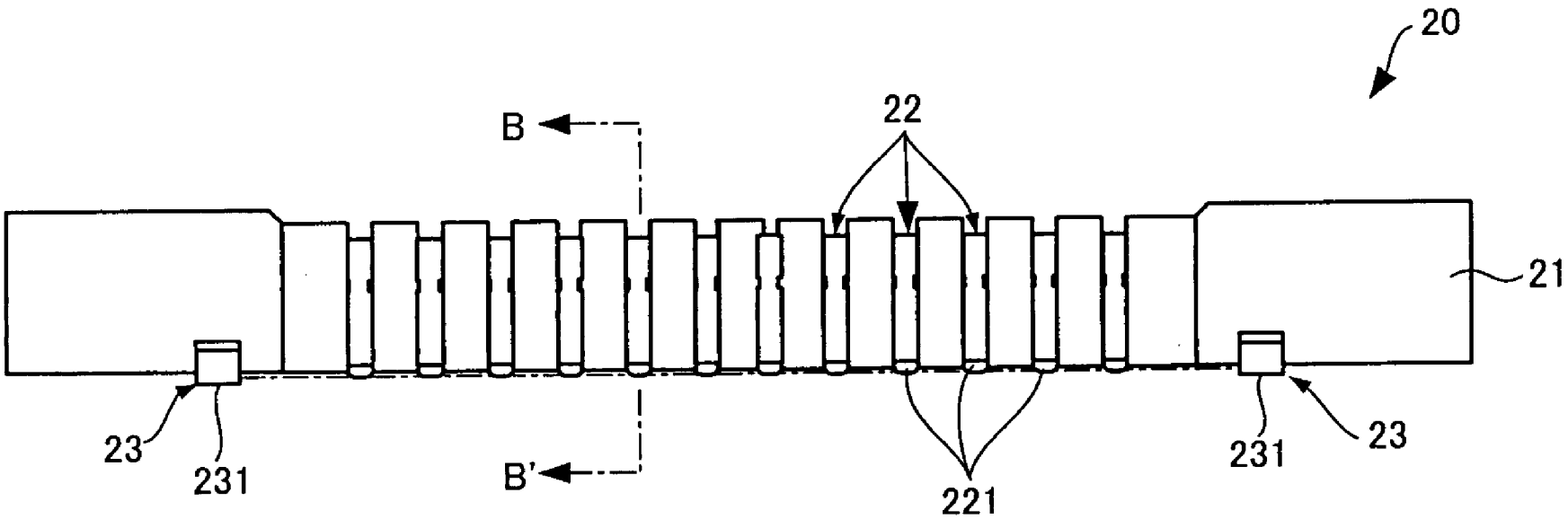
FIG. 5 is a front view of the receptacle connector shown in FIG. 4.
Figure 6:
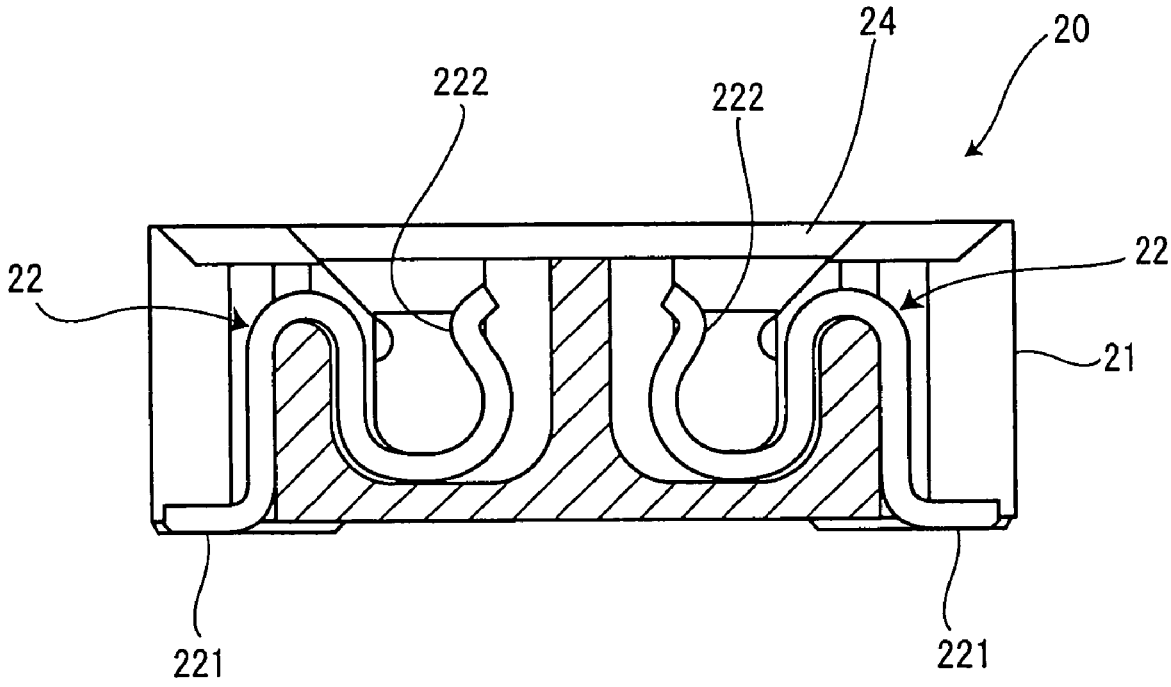
FIG. 6 is a cross-sectional view of the receptacle connector shown in FIGS. 4 and 5 taken along the line B–B' in FIG. 5.

FIG. 4 is a plan view of the receptacle connector 20 in the connector assembly according to the present exemplary embodiment of the invention. FIG. 5 is a front view of the receptacle connector 20 shown in FIG. 4. FIG. 6 is a cross-sectional view of the receptacle connector 20 taken along the line B–B' in FIG. 5.

As with the counterpart plug connector 10 shown in FIG. 1, a receptacle connector 20 shown in FIG. 4 is a surface-mounted connector, which is configured to be mounted on a surface of a circuit board (not shown). Again, the receptacle connector 20 shown has not yet been mounted on the circuit board. As with the plug connector 10 shown in FIG. 1, the receptacle connector 20 has an insulating housing 21 extending horizontally in FIG. 4, plural contacts 22 arranged in two rows along the length (the longitudinal direction) of the insulating housing 21, and soldering pegs 23 disposed in respective guiding sections 24 at the longitudinal ends of the insulating housing 21.

The exemplary insulating housing 21 shown in FIG. 4 is also made of resin, and in FIG. 4, the contacts 22 in the upper row and the contacts 22 in the lower row are arranged opposing each other. Each contact 22, which is made of a copper alloy in the illustrated embodiment, is substantially S-shaped (see FIG. 6) and therefore is resilient. One end of each contact 22 constitutes a tine section 221 to be soldered to a pad on the circuit board (not shown), and the other end thereof constitutes a contact section 222 formed taking advantage of the arc of the S shape. When the plug connector 10 shown in FIG. 1 is connected to the receptacle connector 20, the contact sections 222 come into contact with the contacts 12 of the plug connector 10, and the electrical connection between the contacts 12 and 22 is established. When the connectors are connected to each other, the projections 122 of the contacts 12 of the plug connector 10 make the contacts 22 of the receptacle connector 20 deflect inwardly (toward the respective opposing contacts 22), thereby assuring the electrical connection between the contacts 12 and 22 owing to the resiliency. The tine sections 221 of the contacts 22 of the receptacle connector 20 have the same height (that is, are aligned at the bottom, as shown by the alternate short and long dash line in FIG. 5) and are attached in the insulating housing 21 by press fitting, for example. As with the soldering pegs 13 of the plug connector 10, the soldering pegs 23 shown in FIGS. 4 and 5 may be formed only by die cutting of one copper alloy plate, for example, and each have a soldering part 231, which is to be soldered to a pad on the circuit board and serve the same as the soldering peg 13 of the plug connector 10. In addition, as with the soldering pegs 13 of the plug connector 10, the soldering pegs 23 shown in FIGS. 4 and 5 are attached to the insulating housing 21 in a movable manner. Referring to FIG. 5, the soldering parts 231 of the soldering pegs 23 protrude slightly below the tine sections 221 due to their own weights. However, when the receptacle connector 20 shown in FIG. 5 is mounted on the circuit board, the tine sections 221 and the soldering parts 231 become coplanar. Therefore, the receptacle connector 20 shown in FIG. 4 can be reliably electrically connected to the circuit board by the tine sections 221 and can be reliably fixed thereto by the soldering parts 231.

Now, how the soldering pegs 13 and 23 work when the plug connector 10 shown in FIG. 1 and the receptacle connector 20 shown in FIG. 4 are connected to each other will be described.

Figure 7:
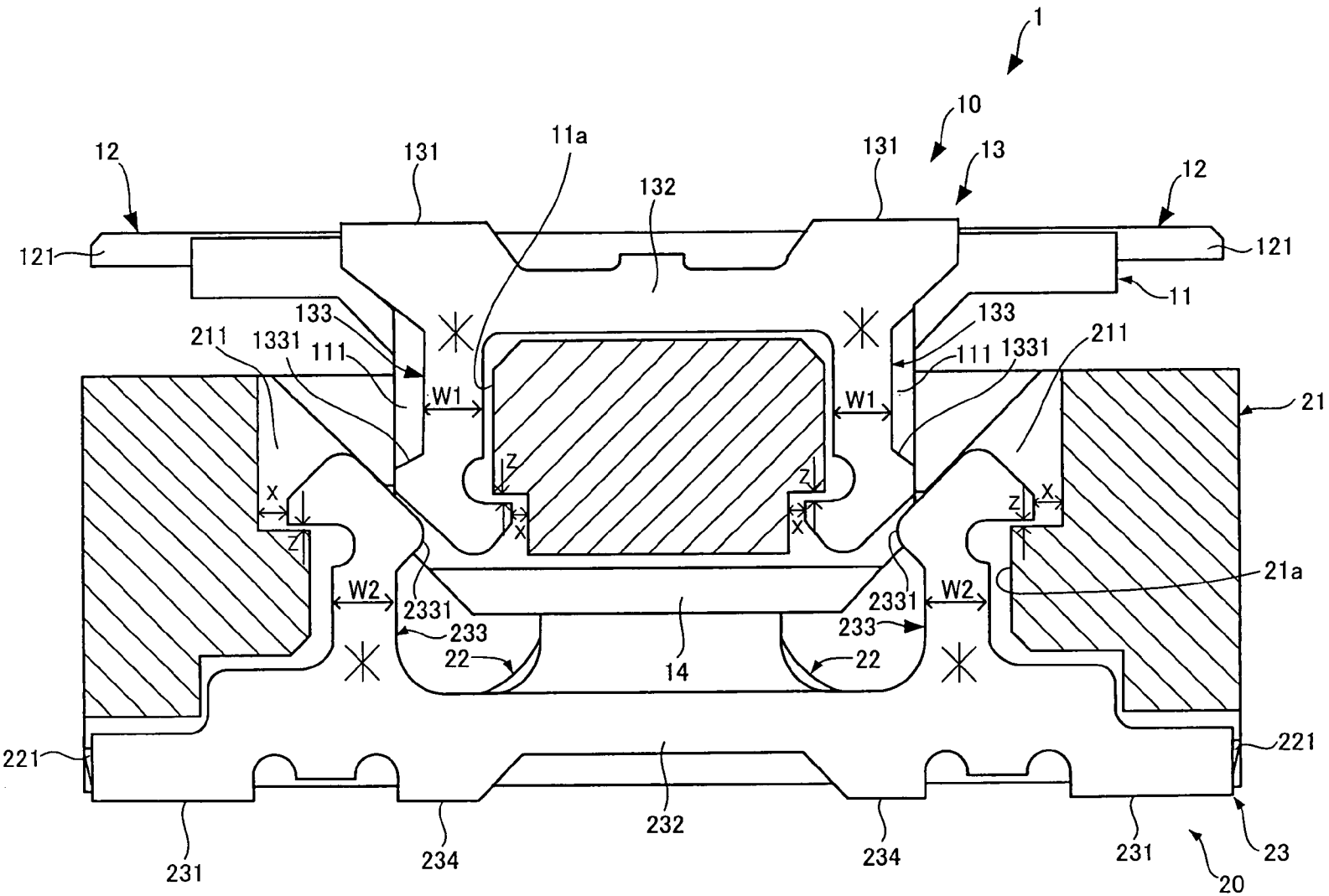
FIG. 7 shows the plug connector shown in FIG. 1 and the receptacle connector shown in FIG. 4 being connected to each other.

FIG. 7 shows the plug connector of FIG. 1 and the receptacle connector of FIG. 4 being connected to each other.

FIG. 7 shows the connector assembly 1 according to an exemplary embodiment, the plug connector 10 shown in FIG. 1 being shown at the upper part of this drawing, and the receptacle connector shown in FIG. 4 being shown at the lower part thereof. FIG. 7 is intended primarily to illustrate the soldering pegs 13, 23 of the connectors 10, 20, so that the contacts 12, 22 of the connectors 10, 20 are shown only in part, including the tine sections 121, 221. Furthermore, in the actual connector assembly, when the plug connector 10 shown in FIG. 1 and the receptacle connector 20 shown in FIG. 4 are connected to each other, the connectors 10 and 20 have already been mounted on the surfaces of the respective circuit boards. However, in FIG. 7, the connectors 10 and 20 being connected to each other are yet to be mounted on the circuit boards, and the coplanarity of the tine sections 121 and the soldering parts 131 of the connector 10 and of the tine sections 221 and the soldering parts 231 of the connector 20 are neglected.

The soldering peg 13 (23) of the connector 10 (20) has soldering parts 131 (231) at the ends, a base part 132 (232) connecting the soldering parts 131 (231) to each other, and a pair of opposing engaging arms 133 (233) protruding from the base part 132 (232). The paired engaging arms 133 (233) are resiliently deformable and each have a locking protrusion 1331 (2331). The locking protrusions 1331 of the soldering peg 13 of the plug connector 10 shown in the upper area of the drawing protrude outwardly (away from their respective opposing engaging arms 133), and the locking protrusions 2331 of the soldering peg 23 of the receptacle connector 20 shown in the lower area of the drawing protrude inwardly (toward their respective opposing engaging arms 233). In the insulating housing 11 (21) of the plug (receptacle) connector 10 (20), soldering peg accommodating chambers 111 (211) for accommodating the soldering peg 13 (23) in a movable manner are provided in the guiding section 14 (24) at each of the longitudinal ends of the insulating housing 11 (21). The soldering peg 13 (23) of the plug (receptacle) connector 10 (20) is disposed in the soldering peg accommodating chamber 111 (211). The soldering peg 13 (23) disposed in the soldering peg accommodating chamber 111 (211) is spaced apart from a wall 11*a* (21*a*) of the insulating housing that defines the soldering peg accommodating chamber 111 (211). As for the pair of engaging arms 133 (233), each engaging arm 133 (233) is spaced apart from the wall by a distance X, indicated by the double-headed arrow X, in the X direction, the horizontal direction in FIG. 7 and spaced apart from the wall by a distance Z, indicated by the double-headed arrow Z, in the Z direction, the vertical direction in FIG. 7. These spacings in two directions allow the paired engaging arms 133 (233) of the soldering peg 13 (23) of the connector 10 (20) to pivot. That is, when connecting the connectors 10 and 20 shown in FIG. 7 to each other, the plug connector 10 shown in the upper area of the drawing is inserted into the receptacle connector 20 shown in the lower area thereof. At this time, first, the locking protrusions 1331 of the soldering peg 13 come into contact with the locking protrusions 2331 of the soldering peg 23. If the insertion of the plug connector 10 is continued, the locking protrusions 1331 and 2331 which are in contact with each other interact, so that each of the engaging arms 133 of the soldering peg 13 is deflected by pivoting inwardly around the asterisk mark (*) in the drawing, and each of the engaging arms 233 of the soldering peg 23 is deflected by pivoting outwardly around the asterisk mark (*) in the drawing. That is, the engaging arms 133, 233 are loaded. Then, the insertion is further continued, and when it is completed, the deflected engaging arms 133, 233 return to their original positions and provide a tactile response. Then, the locking protrusions 1331 of the upper soldering peg 13 and the locking protrusions 2331 of the lower soldering peg 23 are engaged with each other. By feeling the tactile response, the operator can know that the connectors 10 and 20 are correctly connected to each other. Once the lock protrusions 1331 and 2331 are engaged with each other, the engaging arms 133 and 233 are in exactly the same state as before connection due to their resiliency, and therefore, are substantially unloaded. In the connector assembly 1 according to this embodiment, the tactile response, which is produced when the connectors 10 and 20 are correctly connected to each other, is provided mainly by the soldering pegs 13, 23, and the contacts 12, 22 shown in FIGS. 3 and 6 provide no or little tactile response. In addition, in the connector assembly 1 according to this embodiment, the strength of the tactile response depends on the displacements of the engaging arms 133, 233 during connection of the connectors 10 and 20. Since the soldering pegs 13, 23 are intended primarily to fix the connectors to the circuit boards, once the connectors 10 and 20 are connected to each other, the soldering pegs are less responsible for connection of the connectors than the contacts 12 and 22. Thus, in the connector assembly 1 according to this embodiment, once the connectors are connected to each other, the engaging arms 133, 233 can be substantially unloaded. Thus, the displacements of the engaging arms 133, 233 are increased, so that a more positive tactile response can be provided when the connectors 10 and 20 are correctly connected to each other. The "substantially unloaded" state includes a state where the engaging arms 133, 233 are in contact with the respective counterpart engaging arms 233, 133. In addition, the thicknesses of the engaging arms 133, 233 (that is, the widths the engaging arms along the surface thereof, indicated by reference symbols W1, W2 in FIG. 7) are more than the thicknesses of the contacts 12, 22 shown in FIGS. 3 and 6, respectively, and thus, the engaging arms 133, 233 have an increased rigidity. Thus, a further more positive tactile response can be provided.

The soldering pegs 13 and 23 are attached to the insulating housings 11 and 21, respectively, in a movable manner as described above; and the movability is assured by the spacings in the Z direction. That is, the spacings can serve not only for accommodating the engaging arms 133, 233 deflected to provide a tactile response but also for assuring the movability of the soldering pegs 13, 23, and thus, the connectors can be reduced in size. In addition, if press fitting is used, the part of the insulating housing to be subject to press fitting has to be made thicker. However, the soldering pegs 13, 23 of the connectors 10, 20 are not attached by press fitting, so that there is no need to provide the thicker parts on the insulating housings 11, 21, and accordingly, the connectors can be reduced in size. Since the soldering pegs 13, 23 may be formed only by die cutting, without bending, as described above, the footprints (projection areas) of the soldering pegs on the connectors 10, 20 can be reduced, and thus, the connectors can be further reduced in size. Furthermore, since the soldering pegs may be formed by die cutting, the thicknesses of the engaging arms can be adjusted, and a desired rigidity can be imparted to the engaging arms. The higher the rigidity, the more positive tactile response can be provided.

In addition, the soldering peg 23 of the receptacle connector 20 shown in the lower area of FIG. 7 has a pair of supporting protrusions 234 located inside of the pair of engaging arms 233. As described above, since the soldering pegs 13, 23 of the connectors 10, 20 may be formed by die cutting, the soldering pegs may have rough surfaces. Thus, when the engaging arms 133, 233 are deflected during connection of the connectors, high friction is produced between the locking protrusions 1331 and 2331 in contact with each other, so that the engaging arms 233 of the receptacle connector 20 experience not only the force to deflect them outwardly but also a force to pull them inwardly due to the friction. The pair of supporting protrusions 234 on the soldering peg 23 of the receptacle connector 20 is slightly retracted compared with the soldering parts 231 formed outside thereof. When such a force to pull the engaging arms 233 inwardly is exerted thereon, the pair of supporting protrusions 234 comes into contact with the surface of the circuit board, thereby preventing the engaging arms 233 from falling inwardly.

I claim:

1. A connector assembly comprising a pair of connectors, each of the connectors including:

an insulating housing;

contacts arranged in at least one row in the longitudinal direction of the insulating housing; and soldering pegs that are disposed at the longitudinal ends of the insulating housing and capable of moving vertically;

wherein the soldering pegs of one of the connectors each have a pair of engaging arms each of which is spaced apart from a wall of the insulating housing of the connector and configured to resiliently deform outwardly;

the soldering pegs of the other of the connectors each have a pair of engaging arms each of which is spaced apart from a wall of the insulating housing of the connector and configured to resiliently deform inwardly; and the engaging arms of the soldering pegs each have a locking protrusion, the locking protrusions of the engaging arms interacting during connection of the connectors to resiliently deform the engaging arms, the interaction between the locking protrusions being eliminated when the connectors are completely connected to each other, allowing the engaging arms to relax.

2. The connector assembly according to claim 1, wherein the engaging arms of the soldering pegs have a thickness larger than that of the contacts of the connectors.

3. The connector assembly according to claim 1, wherein the soldering pegs are formed by die cutting without bending.

4. The connector assembly according to claim 3, wherein the engaging arms of the soldering pegs have a thickness larger than that of the contacts of the connectors.

5. A surface mounted connector, comprising:

an insulating housing;

contacts arranged in at least one row in the longitudinal direction of the insulating housing; and soldering pegs that are movably connected at the longitudinal ends of the insulating housing having a pair of engaging arms configured to interact with a pair of engaging arms of a mating connector to resiliently deform the engaging arms during connection of the connector and the mating connector and to relax when the connectors are completely connected to engage an insulated housing of the mating connector.

6. The surface mounted connector of claim 5, wherein the engaging arms each have a locking protrusion formed thereon, the locking protrusion interacting with a locking protrusion formed on a corresponding engaging arm of the mating connector to resiliently deform the engaging arms.

7. The surface mounted connector of claim 6, wherein the engaging arms are spaced apart from a wall of the insulating housing of the connector to allow the engaging arms to pivot during connection to the mating connector.

8. A connector assembly comprising:

a plug connector surface mounted to a first circuit board and having an insulating housing with contacts arranged in at least one row in the longitudinal direction of the insulating housing and soldering pegs movably connected to the longitudinal ends of the insulating housing; and a receptacle connector surface mounted to a second circuit board and having an insulating housing with contacts arranged in at least one row in the longitudinal direction of the insulating housing and soldering pegs movably connected to the longitudinal ends of the insulating housing;

wherein the soldering pegs each have a pair of engaging arms spaced apart from a wall of the respective insulating housing and configured to interact during connection of the connectors to resiliently deform the engaging arms and to eliminate the interaction when the connectors are completely connected to each other, allowing the engaging arms to relax.

9. The connector assembly of claim 8, wherein the engaging arms each have a locking protrusion formed thereon, the locking protrusion interacting with the locking protrusion formed on a corresponding engaging arm of the mating connector to resiliently deform the engaging arms.

10. The connector assembly of claim 9, wherein the locking protrusions each interlock with the insulating housing of the respective mating connector when the engaging arms are relaxed.

* * * * *